United States Patent [19]

Cadars

[11] Patent Number: 4,700,749

[45] Date of Patent: Oct. 20, 1987

[54] SWIRL-GENERATING, HELICAL AGITATOR FOR HEAT EXCHANGER TUBES

[75] Inventor: Patrick Cadars, Maurepas, France

[73] Assignee: Societe Anonyme Francaise du Ferodo, Paris, France

[21] Appl. No.: 910,811

[22] Filed: Sep. 23, 1986

Related U.S. Application Data

[63] Continuation of Ser. No. 652,986, Sep. 21, 1984, abandoned, which is a continuation of Ser. No. 284,316, Jul. 17, 1981, abandoned, which is a continuation of Ser. No. 92,828, Nov. 9, 1979, abandoned.

[30] Foreign Application Priority Data

Nov. 24, 1978 [FR] France ..... 78 33240

[51] Int. Cl.[4] ..... F15D 1/02

[52] U.S. Cl. ..... 138/38; 165/177

[58] Field of Search ..... 138/38; 165/109.1, 177, 165/179

[56] References Cited

U.S. PATENT DOCUMENTS 1,672,617 6/1928 Lasker ..... 138/38
4,265,275 5/1981 Heller et al. ..... 138/38

FOREIGN PATENT DOCUMENTS 7333390 4/1975 France .
7826785 4/1980 France .
8320 of 1894 United Kingdom .

OTHER PUBLICATIONS

British Patent Document No. 1003, Date Unknown.

*Primary Examiner*—Stephen Marcus
*Assistant Examiner*—Mark Thronson
*Attorney, Agent, or Firm*—Neil F. Markva

[57] ABSTRACT

A swirl-generating helical agitator for tubular heat-exchangers comprises a strip of material twisted into a helix and has a cross-section including opposed double inflections. The double inflections have lateral portions inclined at an angle of inclination with respect to and on either side of a central portion.

9 Claims, 4 Drawing Figures

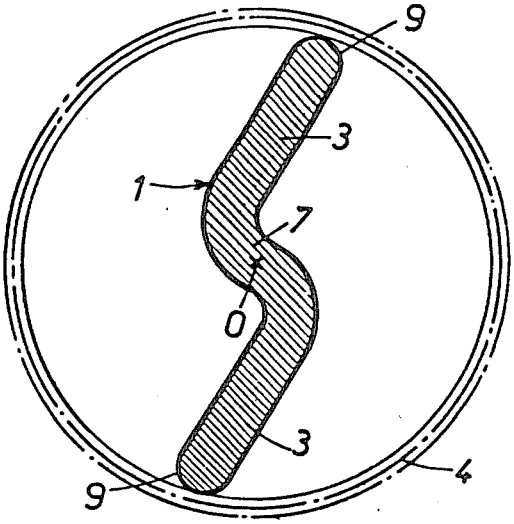
FIG. 1
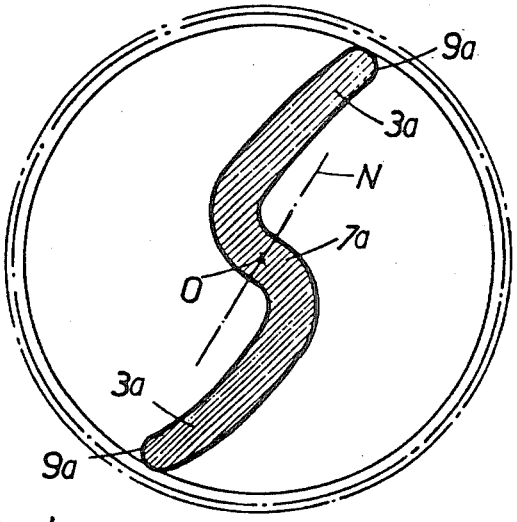
FIG. 2
FIG. 3
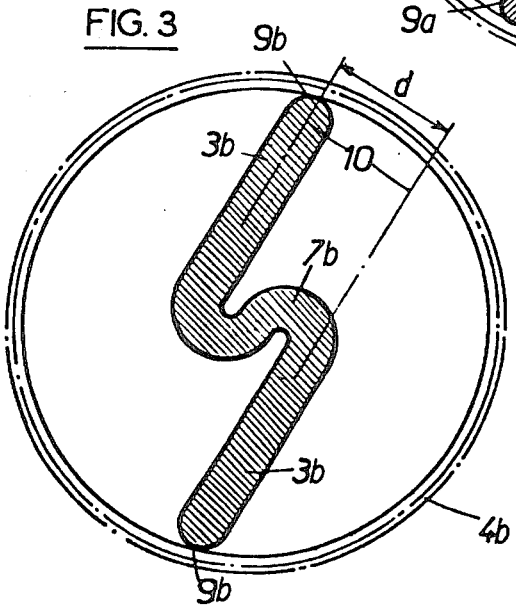

SWIRL-GENERATING, HELICAL AGITATOR FOR HEAT EXCHANGER TUBES

This is a continuation of application Ser. No. 652,986, filed Sept. 21, 1984, now abandoned, which is a continuation of Ser. No. 284,316, filed July 17, 1981, now abandoned, which is a continuation of Ser. No. 92,828, filed Nov. 9, 1979, now abandoned.

FIELD OF THE INVENTION

The present invention relates to tubular heat-exchangers and to swirl generating helical agitators intended to be disposed therein.

BACKGROUND OF THE INVENTION

Agitators formed of a strip of material twisted into a helix and having a cross-section with two reverse or double inflections are known. When such an agitator is disposed in a tube, a fluid flowing therethrough impinges upon the concave faces of the helical agitator. Pressure losses are notably reduced within a tube without affecting the conditions of heat transfer. Such a prior art device is shown in the applicant's French Pat. No. 78 26 785 bearing Publication No. 2,436,959. In this known device, the cross-section of the helically twisted material has a central portion thicker than the inflected lateral portions which have an arcuate profile.

Continued research enabled the Applicant to discover other cross-sectional shapes enabling the fluid circulation conditions to be improved and the manufacture of the agitators to be facilitated still further.

SUMMARY OF THE INVENTION

The present invention is directed to further cross-sectional shapes of such known helical agitators which further enable the fluid circulation conditions to be improved and to further facilitate the manufacture of such agitators. The cross-section of the strip of twisted material includes opposed double inflections having lateral portions inclined at an angle of inclination with respect to and on either side of a central portion. The lateral portions extend in opposed directions outwardly from the central portion.

Further features of the cross-sectional shape is that it is symmetrical with respect to the longitudinal axis of the agitator. The angle of inclination of the lateral portions with respect to the central portion does not exceed 150 degrees. The inclined lateral portions may be either straight or curved. The opposed double inflections form a double fold that provides the agitator with sufficient rigidity to dispense with the central core in certain cases. In other instances, it is even possible to make the central portion thinner than the lateral portions. The agitator may have a cross-section of substantially constant thickness. The ends of the lateral portions may be rounded to facilitate the inscription of the agitator into the heat exchanger tube. Regardless of whichever cross-sectional shape is used with respect to this invention, the helical agitator may be manufactured by extruding thermoplastic material through a die-plate of appropriate section or by means of a metal strip.

The double fold embodied in the agitator endows the same with sufficient rigidity to make it possible in certain cases to dispense with the central core and even to make the central portion thinner than the lateral portions.

The agitator may have a cross-section of substantially constant thickness, the ends of the lateral portions being preferably rounded, thereby facilitating inscription of the agitator in the exchanger tube.

Irrespective of the cross-sectional shape to be adopted, the agitator can be manufactured by extruding thermoplastic material through a die-plate of appropriate section, or by means of a metal strip.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 1 is a cross-sectional view of a first embodiment of a helical agitator made in accordance with this invention.

FIG. 2 is a cross-sectional view of a further embodiment of a helical agitator made in accordance with this invention.

FIG. 3 is another cross-sectional view of another embodiment of a helical agitator made in accordance with this invention.

DETAILED DESCRIPTION

Figure 4:
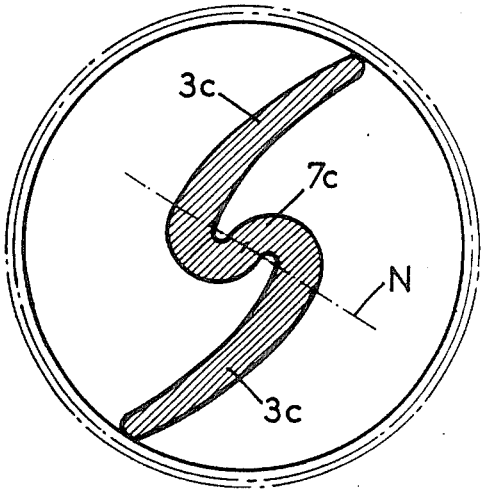
FIG. 4 is a cross-sectional view of a still further embodiment of the invention.

The embodiment of FIG. 1 includes lateral portions 3 which are inclined at substantially right angles with respect to and on either side of a central portion 7. The disposition of the lateral portions 3 is symmetrical with respect to the longitudinal axis of agitator 1 which axis passes through the center 0 of the agitator cross-section. Lateral portions 3 have a constant thickness substantially equal to that of central portion 7. Rounded ends 9 of lateral portions 3 facilitate insertion of the agitator 1 into the tube 4. Lateral portions 3 and 7 are straight in this embodiment.

As it is well known, the sectional views as shown in the FIGS. 1, 2 and 3 constitute the shape of the helically twisted agitator generated by the plane which cuts the generator at that location. In other words, at any location where that helical agitator is cut by a plane, that is, perpendicular to the longitudinal axis of the agitator, that cross-sectional view is represented in FIGS. 1, 2 and 3. As is well known, this type of swirl-generating, helical agitator is twisted about the longitudinal axis thereof.

In the embodiment shown in FIG. 2, the lateral portions **3*a* have a profile which is curved inwardly toward a plane N that is normal to the center portion 7*a* and passes through the center 0 which is at the location of the longitudinal axis of the agitator. The thickness of lateral portions 3*a* tapers toward the rounded ends 9*a*. Otherwise, the cross-section of the agitator shown in FIG. 2 is identical to that of the embodiment shown in FIG. 1**.

The embodiment as shown in FIG. 3 includes a central or middle portion **7*b* having a double S-shaped curvature. The lateral portions 3*b* are shown as being straight and of constant thickness. However, portions 3*b* may also be inwardly curved and have a variable thickness such as is shown in the embodiment of FIG. 2. In this embodiment, the central portion 7*b* is thinner in thickness than the lateral portions 3*b* which have rounded ends 9*b***.

The medians of the outwardly-directed lateral portions 3*b* in FIG. 3 are a spaced distance d apart with respect to each other. Distance d between medians 10 of lateral portions 3*b* is in the range of between 0.2 to 0.6 times the diameter of the agitator. This distance d may also be expressed in the following relationship with respect to the outer diameter D of the agitator.

As in evident in FIG. 4, the curvature of the lateral portions 3*c* connected to the central portion 7*c* is less than the maximum curvature in the S-shaped central portion 7*c* at the inner ends of the lateral portions 3*e* connected to the central portion 7*c*.

ADVANTAGES OF THE INVENTION

The swirl-generating, helical agitators made in accordance with this invention have been tested in comparison with the exemplary embodiment described in applicant's French Pat. No. 78 26 785. It was found that there was a smaller overall pressure loss in both directions of circulation within the heat exchanger tube in which the tests were conducted.

While the swirl-generating, helical agitator for heat-exchanger tubes has been shown and described in detail, it is obvious that this invention is not to be considered as being limited to the exact form disclosed, and that changes in detail and construction may be made therein within the scope of the invention, without departing from the spirit thereof.

I claim:

1. A swirl-generating, helical agitator for use in combination with a heat exchanger tube, said agitator comprising:

(a) a strip of material twisted into a helix to be received by said tube, (b) the cross-section of said strip consisting of an S-shaped central portion including opposed double inflections and two lateral portions inclined with respect to and on either side of said central portion with each lateral portion connected to an outer end of the central portion to form a symmetrical angular structure defining an angle of inclination between each lateral portion and the central portion, (c) said lateral portions have a length greater than the length of the central portion and extend in opposed directions outwardly from the central portion.

2. An agitator according to claim 1, wherein the lateral portions are straight.

3. An agitator according to claim 1, wherein the lateral portions are curved with a curvature that is less than the maximum curvature in said S-shaped central portion.

4. An agitator according to claim 1, wherein the lateral portions comprise incurved agitator portions having concave faces.

5. An agitator according to claim 1, wherein the lateral portions are curved inwardly toward a plane that is normal to said central portion and passes through the center of the central portion.

6. An agitator according to claim 1, wherein the medians of the outwardly-directed lateral portions are a spaced distance apart with respect to each other, said spaced distance being in the range of between 0.2 and 0.6 times the diameter of the agitator.

7. An agitator according to claim 1, wherein the thickness of the lateral portions is greater than the cross-section of the central portion.

8. An agitator according to claim 1, wherein the thickness of the cross-section of the lateral portions tapers inwardly toward the outward ends of the lateral portions.

9. In combination:

(a) a heat-exchanger tube having at least one swirl-generating, helical agitator disposed therein, (b) said agitator comprising a strip of material twisted into a helix about its longitudinal axis, (c) the cross-section of said strip including an S-shaped central portion and lateral portions inclined with respect to and on either side of said central portion with each lateral portion connected to a respective outer end of the central portion to form an angular structure defining respective angles of inclination at the outer ends of the central portion, (d) said lateral portions extending in opposed directions outwardly from the central portion and comprising incurved agitator portions having concave faces, (e) said agitator being effective to cause the fluid flowing therethrough to impinge upon said concave faces of the incurved agitator portions.

* * * * *